United States Patent [19]

Matsuzaki et al.

[11] Patent Number: 4,518,670

[45] Date of Patent: May 21, 1985

[54] RECORDING MATERIAL FOR ELECTROPHOTOGRAPHY COMPRISING AMORPHOUS SILICON CONTAINING NITROGEN

[75] Inventors: Masatoshi Matsuzaki, Fussa; Toshinori Yamazaki; Hiroyuki Nomori, both of Hachioji, all of Japan

[73] Assignee: Konishiroku Photo Industry Co., Ltd., Tokyo, Japan

[21] Appl. No.: 500,625

[22] Filed: Jun. 3, 1983

[30] Foreign Application Priority Data

Jun. 12, 1982 [JP] Japan ..... 57-101085

[51] Int. Cl.[3] ..... G03G 5/082

[52] U.S. Cl. ..... 430/58; 430/65; 430/84

[58] Field of Search ..... 430/57, 58, 65, 84

[56] References Cited

U.S. PATENT DOCUMENTS 4,394,425 7/1983 Shimizu et al. ..... 430/65

*Primary Examiner*—John D. Welsh

*Attorney, Agent, or Firm*—Frishauf, Holtz, Goodman & Woodward

[57] ABSTRACT

Disclosed is a multilayered electrophotographic recording material comprising a charge transfer layer and a charge generating layer on a substrate. The layers are comprised of essentially amorphous silicon. At least 1 atomic percent of nitrogen is present in the charge transfer layer.

6 Claims, 10 Drawing Figures

RECORDING MATERIAL FOR ELECTROPHOTOGRAPHY COMPRISING AMORPHOUS SILICON CONTAINING NITROGEN

BACKGROUND OF THE INVENTION

The present invention relates to a photoreceptor and more particularly to, e.g., an electrophotographic photoreceptor.

There are conventionally known those electrophotographic photo-receptors such as selenium photoreceptors, As-, Te- or Sb-doped selenium photoreceptors, ZnO- or CdS-dispersed resin binder-having photoreceptors, and the like. However, these photoreceptors have problems with respect to environmental pollution, the thermal stability and the mechanical strength thereof. On the other hand, in recent years there have been proposed electrophotographic photo-receptors comprised principally of amorphous silicon (a-Si). The a-Si has the so-called dangling bond which is formed by the severing of the bonding of Si-Si, and this defect causes many localized levels to be present inside the energy gap. For this reason, the hopping conduction of the thermal excitation carrier is such as to cause the dark resistance to be small, and the photo-excitation carrier is trapped by the localized levels to deteriorate the photoconductivity. Accordingly, the above-mentioned defect is compensated by a hydrogen atom(H) to bond the H to Si to thereby fill the gap of the dangling bond.

The resistivity in the dark of this amorphous hydrogenated silicon (hereinafter referred to as a-Si:H) is from $10^8$ to $10^9\Omega$-cm which is as small as about 1/10,000th of that of amorphous Se. Thus, a photoreceptor comprising a single a-Si:H layer has the problem that the dark attenuation speed of the surface potential thereof is high and the initial charging potential is low. On the other hand, however, if the layer is subjected to the irradiation of a visible light or of a light in the infrared region, the resistivity thereof becomes reduced greatly, so that the layer has very excellent characteristics as the photosensitive layer of the photoreceptor.

For providing the a-Si:H with a potential retainability, although the resistivity thereof can be increased up to about $10^{12}\Omega$-cm by doping boron thereinside, not only is it difficult to control precisely the amount of boron but even the resistivity of about $10^{12}\Omega$-cm is not sufficient in the charge retainability for use in the photosensitizing process by the Carlson method.

Further, it is possible to obtain as high a resistance as $10^{13}\Omega$-cm by the introduction of a slight amount of oxygen together with boron, but if this is used in the photoreceptor, the photoconductivity thereof becomes reduced, resulting in a problem that the toe portion of the characteristic curve is deteriorated or residual potential occurs. This results in the problem that the sharp-cutness of the toe portion of the characteristic curve is deteriorated or residual potential occurs.

No thorough study has been made so far on the chemical stability of photoreceptors having the a-Si:H on the surface thereof against the influence of the exposure thereof to air or moisture over a long period, the influence thereupon of chemical compounds formed during corona discharge, and the like. For example, it is known that when a photoreceptor is exposed to air for more than a month, the receptive potential thereof is markedly deteriorated by the moisture in the air. Further, the a-Si:H has poor adherence to such a support material as aluminum, stainless steel, etc., so that it becomes a problem in making practical use of the a-Si:H as an electrophotographic photoreceptor. As a measure to solve this problem it is known that an adhesion layer comprising a silane coupling agent as disclosed in Japanese Patent Publication Open to Public Inspection (hereinafter referred to as Japanese Patent O.P.I. Publication) No. 87154/1980 or such an organic macromolecular compound as a polyimide resin, triazine resin, or the like, as disclosed in Japanese Patent O.P.I. Publication No. 74257/1981 is provided between the a-Si:H layer and the support. In these instances, however, the formation of the adhesion layer and the formation of the a-Si:H layer must be made separately, requiring the use of an additional layer forming machine, so that the production operation is not efficient. In addition, the obtaining of a better quality of the a-Si:H layer requires keeping the base plate (support) at a temperature of normally about 200° C. or higher during the formation of the layer, but the undercoat adhesion layer cannot withstand such a high temperature.

SUMMARY OF THE INVENTION

It is therefore an object of the present invention to provide an a-Si-type photoreceptor which is excellent in both the charge retaining property and the photosensitivity and which has practically usable high impressions, very stable charge retainability and satisfactory adherence to the support.

The above-described object can be accomplished by a recording material (e.g., a photoreceptor) comprising a base plate having thereon a photoconductive layer composed of an amorphous hydrogenated and/or fluorinated silicon (e.g., a-Si:H), the photoconductive layer being provided thereover and/or thereunder with nitrogen-containing amorphous hydrogenated and/or fluorinated silicon (e.g., a-SiN:H) layer(s).

According to the present invention, the above-mentioned nitrogen-containing amorphous hydrogenated and/or fluorinated silicon layer serves as a charge transport layer or as a charge blocking layer for the photoconductive layer (photocarrier generator layer)—this is what we have first discovered—, and accordingly has not only the optimum resistivity but also a satisfactory optical energy gap, so that it is capable of retaining the photosensitivity in a good condition. And if the silicon layer is provided as the topmost layer, the layer enables the protection of the photoconductive layer, retention of the charge, prevention of possible change with time during the storage, prevention of possible deterioration of the photoconductive layer by the repetitive use thereof, prevention of the reverse effect by moisture, improvement of the mechanical strength, prevention of the thermal deterioration, improvement of the heat transferability (particularly adhesion transferability), and the like.

DETAILED DESCRIPTION OF THE INVENTION

Figure 1:
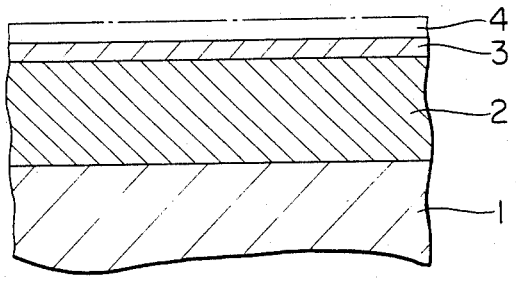
FIGS. 1 through 4 depict respective cross-sections of photoreceptors in accordance with the present invention.

Examples of the application of the present invention to photoreceptors will be illustrated in detail below:

The photoreceptor shown in FIG. 1 has a conductive support base plate 1 in the sheet or drum form composed of Al or stainless steel or of a conductivity-treated glass or plastic sheet, over which is multilayered in order a nitrogen-containing a-Si:H (hereinafter called a-SiN:H) layer 2 as a charge transport layer and a-Si:H layer 3 as a photoconductive layer (photosensitive layer), and, if necessary, a surface improving layer 4 as shown with a long-and-short-dash line in the figure. The nitrogen content of a-SiN:H layer 2 is selected to be from 1 to 30 atomic % to make the carrier transportability sufficient, and the layer's resistance is raised so high as to indicate its resistivity of not less than $10^{10}\Omega$-cm (further to be made intrinsic) by doping into the layer an element belonging to Group IIIA of the periodic table. The doping amount, in the case where layer 2 is formed by the glow discharge method which will be mentioned hereinafter, corresponds to the reaction gas flow proportion of $(B_2H_6/SiH_4)=10$ to 500 ppm. If the above-mentioned nitrogen content and the flow proportion (or resistivity) are out of the above ranges, layers it is difficult to form of a high resistance and of a satisfactory transportability, and therefore they become poor in both charge retainability and photosensitivity. The thickness of the a-SiN:H layer 2 is also important and desirable to be selected from the range of from 2 $\mu$m to 80 $\mu$m. If the thickness is less than 2 $\mu$m, the desired characteristics cannot be obtained, and if exceeding 80 $\mu$m, it takes too much time to form the layer, causing the production thereof to become inefficient.

Figure 2:
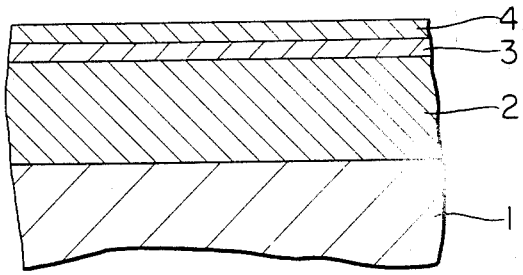

On the other hand, surface improving layer 4 may be formed with various materials and may be composed of at least one selected from the group consisting of SiO, $SiO_2$, $Al_2O_3$, $Ta_3O_5$, $CeO_2$, $ZrO_2$, $TiO_2$, MgO, ZnO, PbO, $SnO_2$, $MgF_2$, ZnS and amorphous hydrogenated and/or fluorinated silicon carbide. As surface layer 4, if, as shown in FIG. 2, an a-SiN:H layer having a thickness of from 100Å to 1 $\mu$m containing 10–50 atomic % of nitrogen is provided, the layer remarkably displays the above-mentioned function. In addition, the layer 2 herein may not necessarily be the a-SiN:H but be a different layer such as of a-SiC:H, or the like.

Figure 3:
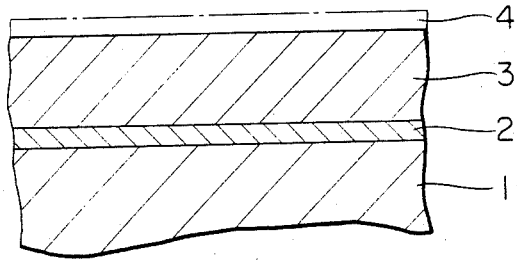

FIG. 3 shows an example wherein a-SiN:H layer 2 is used as the charge block layer. Therefore, in this instance, the nitrogen content is desirable to be from 10 to 50 atomic %. The thickness of this blocking layer should be selected so as to be from 100Å to 1 $\mu$m. Also in this case, surface improving layer 4 is allowed to be similar to the above, but is desirable to be formed with the a-SiN:H as shown in FIG. 4, provided when surface improving layer 4 is an a-SiN:H layer, blocking layer 2 may be composed of a different layer such as of a-SiC:H or the like.

Figure 4:
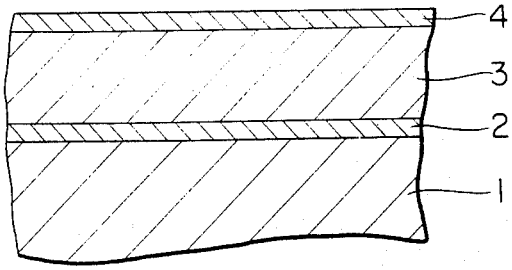

In the element as shown in FIG. 4 wherein a-SiN:H layers 2 and 4 are provided over and underneath photoconductive layer 3, an element belonging to Group IIIA of the periodic table need not be doped into the blocking layer 2, and the nitrogen content of the blocking layer may be from 10 to 50 atomic % and the thickness of the layer may be from 100Å to 1 $\mu$m. In order to cause the layer to function as a blocking layer, differentiating it significantly in the energy gap from a-Si:H layer 3, it is necessary to make the nitrogen content of a-SiN:H layer 2 not less than 10 atomic %, and if the nitrogen content is more than 30 atomic % the dark resistance and photoconductivity become reduced, but the layer still has a sufficient blocking function.

In addition, when considered from the manufacturing aspect, as shown in FIG. 2 and FIG. 4, the provision of the a-SiN:H layers over and underneath a-Si:H layer 3 is desirable because both layers can be formed in the same manner.

In FIG. 1 and FIG. 2, an a-SiN:H layer whose energy gap is larger than that of the charge transport layer or an a-SiN:H layer which is made to be of the $P^+$ type or $N^+$ type by doping impurities is placed between base plate 1 and charge transport layer 2, whereby the structure is made so as to prevent the injection of the charge from the base plate.

In addition, the thickness of the above photoconductive layer 3 (in the case of a photoreceptor provided with the charge transport layer) may be from 2500Å to 10 $\mu$m, and preferably from 500Å to 5 $\mu$m (if no charge transport layer is provided, from 0.5 to 80 $\mu$m). And it is desirable to make the layer intrinsic or highly resistive (particularly in the instances of FIG. 3 and FIG. 4) by the doping of an element belonging to Group IIIA of the periodic table.

Next, the electrical and optical characteristics of the above-mentioned a-SiN:H layer are illustrated below with reference to FIG. 5 through FIG. 7.

Figure 5:
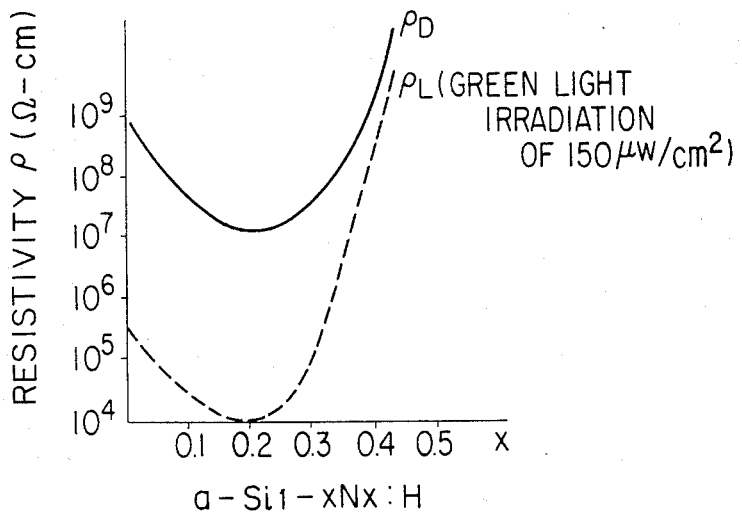
FIG. 5 is a graph depicting the relationship of the change in resistivity to change in the nitrogen content of the $\alpha$-SiN:H.

FIG. 5 shows the change in the resistivity depending on the nitrogen content of the a-SiN:H ($\rho D$ is dark resistivity and $\rho L$ is the resistivity at the time of light irradiation). It is understood from the figure that in order to increase the $\rho D/\rho L$ to improve the carrier's transportability (and photosensitivity), the nitrogen content should be from 1 to 30 atomic % which is the desirable range for the above charge transport layer. However, when the layer is used as a blocking layer, the $\rho D/\rho L$ may be allowed to be small, so that the upper limit of the nitrogen content can be extended up to 50 atomic % (10 to 50 atomic % as the amount of nitrogen).

Figure 6:
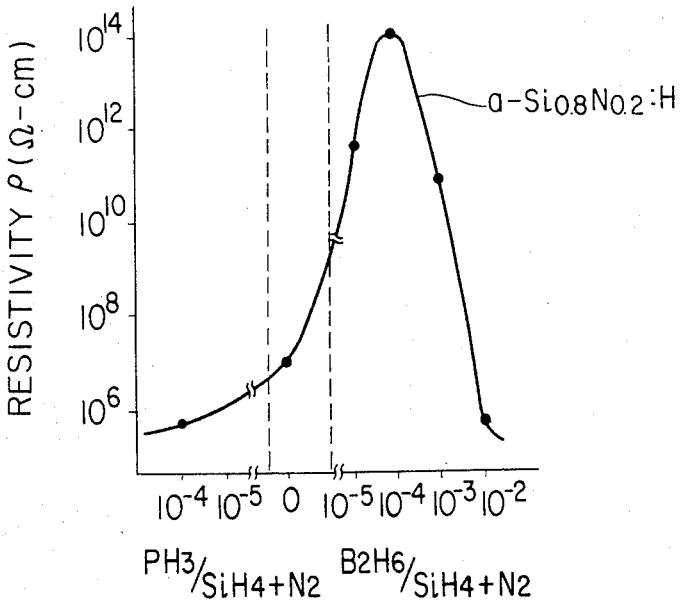
FIG. 6 depicts the relationship of the change of the resistivity to the phosphorus and boron doping content.

On the other hand, according to FIG. 6, the resistivity of the a-SiN:H layer can be controlled by the doping amount (flow ratio) of impurities: particularly if the $B_2H_6/SiH_4$ is from 10 to 1000 ppm, the resistivity can be as high as more than $10^{10}\Omega$-cm, whereby the charge retainability of the layer can be improved.

Figure 7:
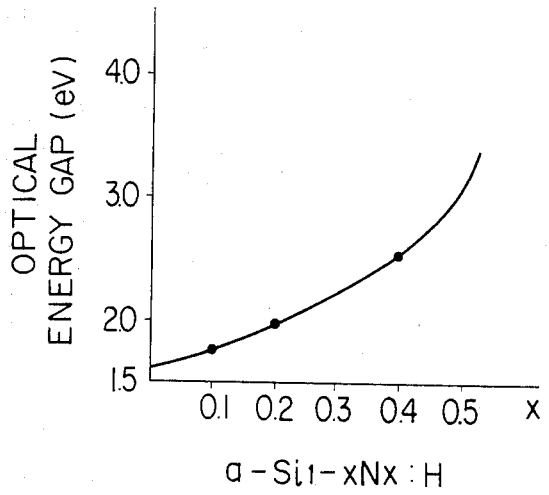
FIG. 7 depicts the relationship of the optical energy gap to the $\alpha$-Si:H content.

It is apparent from FIG. 7 that as the nitrogen content increases, the optical energy gap (about 1.65 eV in the case of the a-Si:H) can be increased and the incident light absorbing characteristic can be controlled. Accordingly, where the a-SiN:H layer is used as a surface improving layer, in order to render the layer sufficiently light-transmissible when particularly visible light or a longer wavelength light is radiated, the nitrogen content should be from 10 to 50 atomic %, and further, within this range, thenitrogen content is desirable to be larger, whereby the a-SiN:H layer is endowed with a wavelength selectability to thereby enable to retain the photosensitivity sufficiently high as well as to select widely the kind of incident light to be used.

In addition, the above a-SiN:H layer needs to contain hydrogen because if it contains no hydrogen the charge retainability is reduced, so that the photoreceptor become unable to be used practically. For this reason, a preferred hydrogen content is from 1 to 40 atomic % (more preferably from 10 to 30 atomic %).

The presence of hydrogen in photoconductive layer 3 is essential to compensate the dangling bond to improve the photoconductivity and the charge retainability, and the hydrogen content of the layer is normally from 1 to 40 atomic %, and preferably from 3.5 to 20 atomic %. The conductive type of control of a-Si:H layer 3 can be made by the doping of impurities during the manufacture, the doping enabling to select the polarity, either positive or negative, of the charging. In order to render a-Si:H layer 3 intrinsic or of the P type, an element belonging to Group IIIA of the periodic table, such as B, Al, Ga, In or Tl may be doped, and the doping amount of any of these elements is preferably from $10^{-3}$ to 5 atomic % (more preferably from $10^{-2}$ to 1 atomic %) for improving the electrical and optical characteristics of the a-Si:H. To cause a-Si:H layer 3 to be of the N type, an element belonging to Group VA of the periodic table, such as N, P, As, Sb or Bi may be doped, and the doping amount of any of these elements is preferably from $10^{-5}$ to 1 atomic % (more preferably from $10^{-4}$ to $10^{-1}$ atomic %) for the same reason as the above. If necessary, oxygen, nitrogen or such a transition metal as chromium, manganese, or the like, may be introduced for increasing the resistivity and sensitization, and controlling the conductivity of the a-Si:H.

In addition, in order to compensate the dangling bonds, fluorine may be introduced in place of or together with the above H to the a-Si to cause the a-Si to be a-Si:F, a-Si:H:F, a-SiN:F, a-SiN:H:F, a-SiC:F or a-SiC:H:F. The amount of added fluorine in this case is preferably from 0.01 to 20 atomic %, and more preferably from 0.5 to 10 atomic %.

A method for producing the above-described photoreceptor and apparatus used therefor will then be illustrated below with reference to FIG. 8.

Inside a vacuum chamber 12 of apparatus 11, the above-mentioned base plate 1 is placed on and fixed to base plate holder 14 so that base plate 1 is heated to a given temperature by a heater 15. A high frequency electrode 17 is arranged so as to face opposite to base plate 1, and a glow discharge is generated between base plate 1 and high frequency electrode 17. In addition, in the figure, numbered 20, 21, 22, 23, 27, 28, 29, 34, 36 and 38 are valves, 31 is a supply source of $SiH_4$ or a gaseous silicon compound, 32 is a supply source of nitrogen in the form of $NH_3$ or of $N_2$, and 33 is a supply source of a carrier gas such as Ar or $H_2$. Although not shown in the figure, supply sourcess of $CH_4$ and $B_2H_6$ are provided as well as the above supply sources. In this glow discharging apparatus, base plate 1, the support made of, e.g., Al, after cleaning the surface thereof, is arranged inside vacuum chamber 12. The air inside vacuum chamber 12 is removed by controlling valve 36 so that the gas pressure thereinside becomes $10^{-6}$ Torr, and base plate 1 is heated to a given temperature, e.g., 30 to 400° C. Subsequently, a highly pure inert gas, as a carrier gas, is used to introduce a mixture gas of appropriately diluted $SiH_4$ or a gaseous silicon compound and $NH_3$ or $N_2$ into vacuum chamber 12, and under a reaction pressure of, e.g., from 0.01 to 10 Torr, a high frequency voltage (e.g. 13.56 MHz) is applied by a high frequency power supplier 16 to the gas, thereby carrying out the glow discharge decomposition of the above reaction gases to deposit a hydrogen-containing a-SiN:H as the afore-mentioned layer 2 (or further, layer 4) on the base plate.

In this instance, by arbitrarily controlling the flow proportion of the silicon compound to the nitrogen compound and the temperature of the base plate, an a-$Si_{1-x}N_x$:H having any desired composition ratio and optical energy gap can be deposited, and the a-SiN:H can be deposited at a rate of not less than 1000 Å/min. without having influence upon the electrical property of the depositing a-SiN:H. In addition, in order to deposit a-SiC:H, methane gas should be used in place of the above-mentioned nitrogen compound. Further, in depositing a-Si:H (photosensitive layer 3), a silicon compound should be decomposed by the glow discharge without supplying the nitrogen compound. Particularly when effecting a glow discharge decomposition of the a-Si:H photosensitive layer to which is arbitrarily added a gaseous compound of an element belonging to Group IIIA of the periodic table, such as $B_2H_6$ silicon compound, the improvement on the photoconductivity as well as high resistivity of the a-Si:H can be accomplished.

As apparent from the above-described producing method and apparatus, the photoreceptor composed principally of the a-SiN:H/a-Si:H of the present invention can be produced by providing in order on the base plate individual layers each of which layers can be differentiated by merely changing the kinds and the flowing amounts of the reaction gases used inside the same apparatus. Therefore, the a-SiN:H layer, particularly as the charge transport layer or as blocking layer, can be efficiently produced. And the a-SiN:H layer has good adherence to the base plate as compared to organic macromolecular compounds and excellent surface effects such as increasing the mechanical strength and the resistance to moisture of the surface.

In addition, aside from the above-described producing method using the glow discharge decomposition process, there are the spattering method, ion-plating method and the method of vaporizing Si under the introduction of the hydrogen activated or ionized by a hydrogen discharge tube (particularly as described in Japanase Patent O.P.I. Publication No. 78413/1981 (Japanese Patent Application No. 152455/1979) by us the applicant), any of which methods may also be used to produce the above-described photoreceptor, wherein, as the reaction gas, in addition to the $SiH_4$, there may be used $Si_2H_6$, $SiF_4$, $SiHF_3$ or derivative gases thereof, or such a lower hydrocarbon gas other than $CH_4$ as $C_2H_6$, $C_3H_8$, $CF_4$ or the like.

Figure 9:
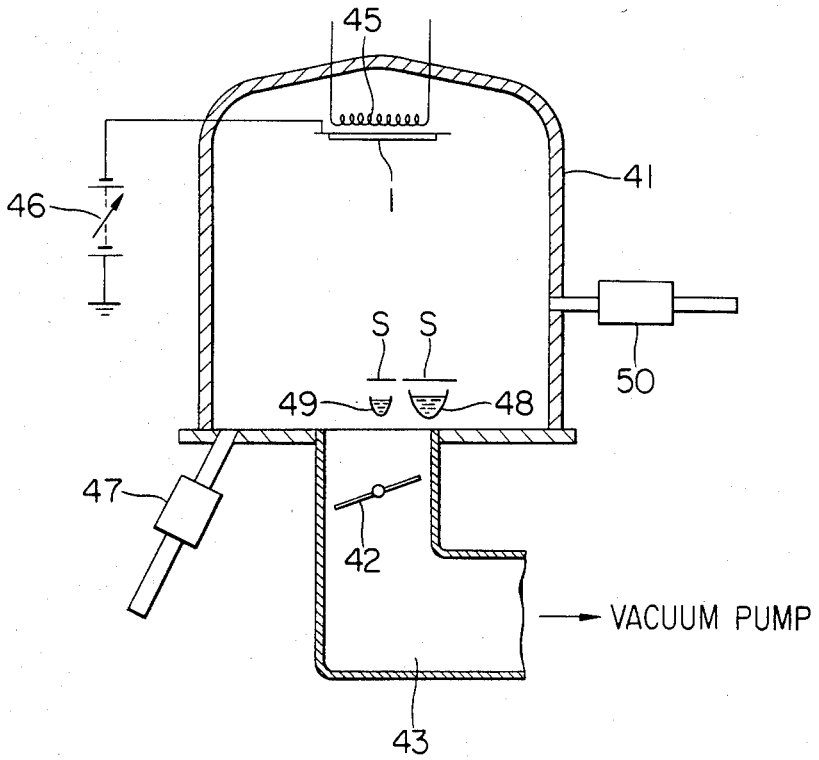
FIG. 9 depicts a vacuum evaporation apparatus useful for producing the photoreceptor of the present invention.

FIG. 9 shows a vacuum evaporation apparatus for use in the preparation of the photoreceptor of the present invention by the vacuum deposition method as described in the above-mentioned Japanese Patent O.P.I. Publication No. 78413/1981.

A belljar 41 is connected through a deaerating pipe 43 having a butterfly valve 42 to a vacuum pump (not shown), thereby causing the inside of belljar 41 to be in a highly vacuum condition such as, e.g., from $10^{-3}$ to $10^{-7}$ Torr. Inside the thus conditioned belljar 41, a base plate 1 is arranged which is heated to 150° to 500° C., and preferably 250° to 450° C., and concurrently to base plate 1 is applied a DC negative voltage of from 0 to −10 KV, preferably from −1 to −6 KV by a DC power source 46. With introducing into belljar 41 the activated hydrogen and ionized hydrogen from a hydrogen gas discharge tube 47 provided by connecting the outlet thereof to belljar 41 so that the outlet faces toward base plate 1, a silicon evaporating source 48 and aluminum evaporating source 49 that are arranged so as to face opposite to base plate 1 are heated and at the same time shutters S are opened so that the silicon and aluminum are evaporated concurrently in an evaporating rate proportion of the former to the latter being, e.g., $1:10^{-4}$ and into belljar 41 the $NH_3$ gas activated by a discharge tube 50, thereby forming a-SiN:H layers 2 and 4 (see FIG. 1 through FIG. 4) containing a given amount of aluminum. In the case aluminum is not to be doped, aluminum vapor source 49 may be left unheated and shutter S may remain closed. During the formation of a-Si:H layer 3 the supply of the $NH_3$ gas should be stopped.

Figure 10:
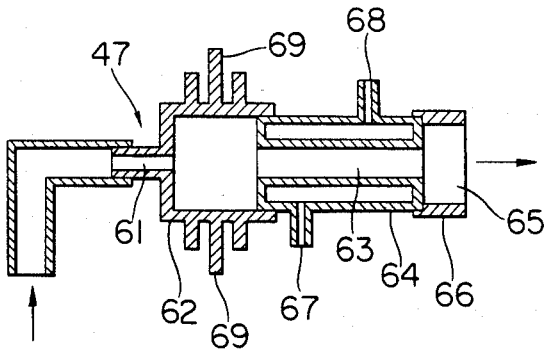
FIG. 10 is a cross-section of the discharge tube.

The structure of discharge tubes 47 and 50 is then illustrated. As FIG. 10 shows, the discharge tube comprises a one-side electrode member 62 in the pipe form having a gas inlet 61, a discharging spacing member 64 composed of, e.g., a glass barrel which surrounds discharging space 63 and which is provided at one end thereof with the one-side electrode member 62, and the-other-side electrode member 66 which is in the ring form having an outlet 65 and which is provided at the other end of the discharging spacing member 64. A DC or AC voltage is applied to between the foregoing one-side electrode member 62 and the-other-side electrode member 66 to thereby cause a gas, e.g., hydrogen gas, supplied through gas inlet 61 to generate a glow discharge in discharging space 63, whereby the active hydrogen and ionized hydrogen ions comprising electron-energetically activated hydrogen atoms or molecules are ejected from outlet 65. The discharging spacing member 64 in the example in the figure is of a double-tubing structure constructed so that cooling water can flow therethrough, and 67 and 68 are the cooling water inlet and outlet, respectively. 69 is the cooling fin of one-side electrode member 62. The distance between the electrodes of the above-mentioned hydrogen gas discharge tube 47 is from 10 to 15 cm, and the voltage to be applied is 600 V and the pressure applied to discharging space 63 is about $10^{-2}$ Torr.

Examples of the present invention is illustrated in detail below:

EXAMPLE 1

Figure 8:
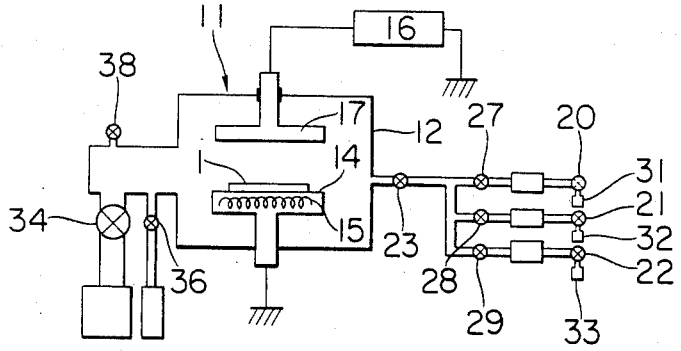
FIG. 8 depicts a vacuum chamber apparatus useful for producing the photoreceptor of the present invention.

An Al base plate washed with trichloroethylene and etched with a 0.1% aqueous NaOH solution and a 0.1% aqueous $HNO_3$ solution was placed inside a glow discharging device as shown in FIG. 8, and a 10 μm-thick boron-doped a-SiN:H layer (charge transport layer) was formed under the following conditions:

| | |
|---|---|
| $SiH_4$ flow | 12 cc/min. |
| $N_2$ flow | 8 cc/min. |
| $B_2H_6/SiH_4$ | 0.01 vol % |
| Gas pressure inside the vacuum chamber | $1.2 \times 10^{-1}$ Torr |
| High frequency voltage | Power 50 W<br>Frequency 13.56 MHz |
| Base plate temperature | 210° C. |

Next, the discharging and supply of $N_2$ were stopped, and a glow-discharging was then carried out under the conditions including the following condition (the other conditions are the same as the above), thereby forming a 1 μm-thick boron-doped a-Si:H layer.

$B_2H_6/SiH_4$ flow ratio: 0.01 vol %

After the discharging was stopped again, the flows were adjusted as shown below, under which conditions the glow discharging was conducted again to thereby form a 1500ÅA-thick a-Si:H layer (surface improving layer: optical energy gap 2.5 eV).

| | |
|---|---|
| $SiH_4$ flow | 4 cc/min. |
| $N_2$ flow | 16 cc/min. |

The thus produced photoreceptor was used to charge the surface thereof by −6 KV corona-discharging for 5 seconds, and after 5-second dark attenuation, the photoreceptor was exposed to a 0.1 lux halogen lamp light to measure the light attenuation characteristic of the surface potential, and then developed with a positive-polar toner, and the developed image was transferred and then fixed. The measured results are as shown in the following table. Fog-free, high image density-having clear images were obtained.

In contrast to the above, other photoreceptors having the compositions of Al base plate/a-SiN:H (boron-doped thickness 15μ) and Al base plate/a-Si:H (boron-doped thickness 15μ), respectively, which were produced in the same manner as the above, were evaluated in the same way, and as a result, it was found the produced images were remarkably deteriorated.

EXAMPLE 2

On the above-mentioned Al base plate a 10 μm-thick Al-doped a-SiN:H layer was formed in accordance with the vacuum deposition method as described in Japanese Patent O.P.I. Publication No. 78413/1981 and under the following conditions:

| | |
|---|---|
| $H_2$ flow | 150 cc/min. (mixed with 5 cc/min. of $N_2$) |
| Evaporating source | Polycrystalline silicon (evaporated by electron gun heating) |
| Evaporating source | Aluminum (evaporated by resistor heating) |
| Ratio of the evaporating amounts | $Si/Al = 3 \times 10^4/1$ |
| Evaporating time | 100 minutes |
| Discharge tube used | DC charge tube (discharging power 350 W) |
| Base plate temperature | 400° C. |
| Base plate voltage | −5 KV |

In the same apparatus, an Al-doped photoconductive layer was formed in a thickness of 1 μm under the following additional conditions (other conditions are the same as the above):

| | |
|---|---|
| $H_2$ flow | 100 cc/min. |
| Ratio of the evaporating amounts | $Si/Al = 6 \times 10^4/1$ |

Further, in the same apparatus, under the conditions of $H_2$ 100 cc/min. and $N_2$ 40 cc/min. and by evaporating Si alone (evaporating time: 1 minute and 30 seconds), a 1500Å-thick a-SiN:H layer as a surface improving layer was formed.

The thus produced photoreceptor was evaluated by testing in a similar manner to Example 1, and consequently, initial surface potential: −700 V, dark attenuation degree: 25%, and half-reduced exposure: 0.8 lux.-sec. were found. The obtained images were free of fog and very clear with high image density.

| Example | No. | 2nd layer | 1st layer | Photoconductive layer | Electrostatic characteristics: Initial potential | Dark attenuation degree | Half-reduced exp. | Image quality |
|---|---|---|---|---|---|---|---|---|
| Examples of the invention | 1 | Blocking 1500Å (SiN:N40%) | — | 15 μm a-Si:H made intrinsic by B | −500 V | 30% | 0.8 lux. sec. | ○ |
| | 2 | Blocking 1500Å (SiN:N40%) | Surface improving 1500Å (SiN:N40%) | 15 μm a-Si:H made intrinsic by B | −650 V | 24% | 0.5 lux. sec. | ◎ |
| | 3 | Transport layer 10 μm B = 50 ppm (SiN:N20%) | — | a-Si:H 1 μm made intrinsic | −680 V | 28% | 0.7 lux. sec. | ◎ |
| | 4 | Transport layer 10 μm B = 50 ppm (SiN:N20%) | Surface improving 1500Å (SiN:N40%) | a-Si:H 1 μm made intrinsic | −750 V | 22% | 0.7 lux. sec. | ◎ |
| | 5 | Transport layer 10 μm B = 50 ppm (SiN:N20%) | Surface improving 1500Å (SiC:$SiH_4$/$CH_4$ = 8/12) | a-Si:H 1 μm non-intrinsic | −700 V | 26% | 0.7 lux. sec. | ◎ |
| | 6 | Transport layer 10 μm (SiC:$SiH_4$/$CH_4$ = 8/12 | Surface improving (SiN:N40%) | a-Si:H 1 μm non-intrinsic | −700 V | 25% | 0.8 lux. sec. | ◎ |
| Comparative examples | 7 | — | — | 15 μm a-SiN:H made intrinsic by B | −600 V | 35% | 2.0 lux. sec. | Fogged |
| | 8 | — | — | 15 μm a-Si:H made intrinsic by B | −300 V | 40% | 0.8 lux. sec. | X |

In the above table,

◎ represents high image density and very excellent image quality,

○ represents high image density and fair image quality, and

X represents being unacceptable for copying.

In addition, the samples in the above-described examples may also be used in positive charging.

It is apparent from the above results that any photoreceptors provided with a-SiN:H layers according to the present invention have satisfactory electrostatic characteristics and are capable of producing good quality images.

BRIEF DESCRIPTION OF THE DRAWINGS

The drawings show the examples of the present invention wherein FIG. 1, FIG. 2, FIG. 3 and FIG. 4 are the sectional views of the respective examples of the electrophotographic photoreceptor of the present invention, FIG. 5 and FIG. 6 are graphs showing the change in the resistivity of the a-SiN:H depending on the amount of nitrogen and doping amounts, FIG. 7 is a graph showing the change in the optical energy gap depending on the amount of nitrogen, FIG. 8 and FIG. 9 are the schematic sectional views of the respective examples of the apparatus for producing the above photoreceptor, and FIG. 10 is the sectional view of the discharging device.

In addition, among these notations used in the above drawings,

1 . . . Support (base plate),

2 . . . Charge transport layer or blocking layer,

3 . . . a-Si:H photosensitive layer (photoconductive layer),

4 . . . Surface improving layer,

11 . . . Glow discharging device,

17 . . . High frequency electrode,

31 . . . Gaseous silicon compound supply source,

32 . . . Gaseous nitrogen compound supply source,

33 . . . Carrier gas supply source,

41 . . . Vacuum evaporation chamber,

47 and 50 . . . Discharge tube,

48 . . . Silicon evaporating source, and

49 . . . Aluminum evaporating source.

What is claimed is:

1. A multilayer recording medium comprising sequentially a substrate, a charge transfer layer and a charge generating layer;

said charge transfer layer being a silicon layer containing at least 1 atomic % nitrogen and consisting essentially of nitrogen-containing amorphous hydrogenated silicon, nitrogen-containing amorphous fluorinated silicon or nitrogen-containing amorphous hydrogenated and fluorinated silicon; and said charge generating layer consisting essentially of amorphous hydrogenated silicon, amorphous fluorinated silicon or amorphous hydrogenated and fluorinated silicon.

2. The recording material of claim 1, wherein said nitrogen-containing silicon layer contains from 1 to 30 atomic % nitrogen and is from 2 μm to 80 μm thick.

3. The recording material of claim 2, wherein said nitrogen-containing slicon layer is doped with an element belonging to Group IIIA of the periodic table to have a high resistivity of not less than $10^{10}$ Ω-cm.

4. The recording material of claim 1, wherein said nitrogen-containing silicon layer contains from 10 to 50 atomic % nitrogen and is from 100Å to 1 μm thick.

5. The recording material of claim 1, wherein said charge generating layer has a thickness of from 5000Å to 5 μm.

6. The recording material of claim 3, wherein said charge generating layer has a thickness of from 5000Å to 5 μm and wherein said charged generating layer is covered with a silicon layer containing from 10 to 50 atomic % nitrogen, having a thickness of from 100 Å to 1 μm and consisting essentially of nitrogen-containing amorphous hydrogenated silicon, nitrogen-containing amorphous fluorinated silicon or nitrogen-containing amorphous hydrogenated and fluorinated silicon.

* * * * *

UNITED STATES PATENT AND TRADEMARK OFFICE

CERTIFICATE OF CORRECTION

PATENT NO. : 4,518,670

DATED : May 21, 1985

INVENTOR(S) : Masatoshi MATSUZAKI et al

It is certified that error appears in the above-identified patent and that said Letters Patent is hereby corrected as shown below:

Column 3, line 49, change "$Ta_3O_5$" to --$Ta_2O_5$--.

Column 4, line 30, change "500Å" to --5000Å--.

Column 4, line 67, change "thenitrogen" to --the nitrogen--.

Signed and Sealed this

*Twenty-sixth* Day of *August 1986*

[SEAL]

*Attest:*

*Attesting Officer*

DONALD J. QUIGG

*Commissioner of Patents and Trademarks*